United States Patent [19]

Schneider

[11] 4,318,490

[45] Mar. 9, 1982

[54] BOTTLE CLOSING DEVICE

[75] Inventor: John F. Schneider, Lake Elmo, Minn.

[73] Assignee: Minnesota Mining & Manufacturing Company, St. Paul, Minn.

[21] Appl. No.: 194,624

[22] Filed: Oct. 6, 1980

[51] Int. Cl.[3] ..... B65D 51/20

[52] U.S. Cl. ..... 215/232; 156/69; 215/251; 220/257; 220/359

[58] Field of Search ..... 215/232, 250, 251; 220/265, 257, 359; 156/69

[56] References Cited

U.S. PATENT DOCUMENTS

| | | | |
|---|---|---|---|
| 1,502,775 | 7/1924 | Hildick et al. . | |
| 2,191,447 | 2/1940 | Beardsley . | |
| 2,876,775 | 3/1959 | Barr, Sr. et al. . | |
| 2,886,198 | 5/1959 | Herter . | |
| 3,394,831 | 7/1968 | Bathish et al. . | |
| 3,480,172 | 11/1969 | Shine . | |
| 3,974,931 | 8/1976 | Moller . | |
| 4,089,432 | 5/1978 | Crankshaw et al. . | |
| 4,266,687 | 5/1981 | Cummings | 215/232 X |

OTHER PUBLICATIONS

Brochure: "The New Sterile I.V.A. Seal$^{TM}$ Replaces the Plastic Cap . . . at 65–80% Less Cost!", U.S. Clinical Products, Inc., 573 Sterling Dr., P.O. Box 1667, Richardson, Texas 75080, dated 1-09-79.

*Primary Examiner*—Donald F. Norton

*Attorney, Agent, or Firm*—Cruzan Alexander; Donald M. Sell; Gary L. Griswold

[57] ABSTRACT

A device for closing bottles comprising a tab portion, a closure portion, and optionally, an indicator portion, at least the closure portion being unaffected by water, and not penetrated by microorganisms and comprising a backing having a conformability of at least 15 and a stiffness of at least 50 and an adhesive on one surface thereof, the adhesive being non-toxic and relatively unaffected by water.

9 Claims, 5 Drawing Figures

BOTTLE CLOSING DEVICE

This invention relates to a device for closing bottles, particularly this invention relates to an adhesive sheet material for closing bottles in an aseptic manner. In a hospital, solutions that are used for intravenous feeding and/or for drug delivery are normally sodium chloride or normal saline solution, 5% dextrose in water, etc. These are normally supplied to the hospital in sealed glass bottles. The hospital prepares the bottled solutions for use by aseptically removing the seal, adding medicament to the bottle and resealing the bottle. Several hundred bottles can, in larger hospitals, be treated in such a fashion on a daily basis. At present, when the bottles are resealed a plastic cap is placed over the bottle top. A cap of the type used to reseal bottles is disclosed in U.S. Pat. No. 3,480,172. When the bottle is to be used, the reseal cap is removed.

Recently a product has been sold which comprises a flat tabbed adhesive cover for the bottle. This cover is utilized rather than the above-noted cap. The flat cover comprises a a polyester film/paper laminate. The cover is applied to the bottle top and is retained on the bottle by means of adhesive on the cover. A tab is utilized to allow application of the cover without contact with the adhesive. The device is designed to leave a small indicator strip on the top of the bottle when the cover is removed. This indicator is adhesive from the cover. It has been found that this cover does not have sufficient conformability to allow it to conform to the top of an I.V. bottle and thus provide a seal which precludes microorganisms from contacting the top of the bottle. Additionally, it has been found that the alleged indicator adhesive which is to be left on the top of the bottle to indicate that the bottle has been resealed and then the reseal opened, has been not consistently attached to the top of the bottle. Thus, a consistent indicator is not present.

Applicant has discovered a device for closing bottles which does not have the above deficiencies. It comprises a device for closing a bottle top comprising a closure portion and a tab portion, said tab portion being attached to said closure portion said closure portion comprising a sheet of polymeric material which is conformable to a bottle top while being relatively stiff, impermeable to microorganisms, relatively unaffected by water, incapable of passing liquid water therethrough, and having a conformability of at least 15 and a stiffness of at least 50, said closure portion containing an adhesive on one major surface thereof, said adhesive covering substantially at least the entire periphery of said major surface thereof and being relatively unaffected by water and non-toxic, said tab portion being relatively non-tacky on at least a portion thereof.

The device can also include an indicator portion which comprises a sheet of polymeric material which is conformable to a bottle neck while being relatively stiff, and having a conformability of at least 15 and a stiffness of at least 50 and which contains an adhesive on one major surface thereof, which major surface corresponds to the adhesvie containing major portion of the closure portion, said adhesive being relatively unaffected by water and non-toxic, said indicator portion being attached to said closure portion by means in said indicator portion for providing a disattachment of said indicator portion from said closure portion by a relatively small amount of force.

Applicant's device has sufficient stiffness to allow the device to be placed over the bottle for closure with one hand without bending and touching the hand at the closure portion and contaminating the closure portion. However, the device has sufficient conformability to allow it to follow the contours of the bottle top and thus seal the bottle and maintain the contents of the bottle therein. This also prevents microorganisms from contacting the top of the bottle. As noted, the device can contain an indicator portion which is retained on the bottle neck when the closure portion and tab portion of the device are removed. This indicates to the user that the bottle has been resealed and that the reseal has been removed. Thus, the user should be cautious because the bottle, no doubt, contains some medicament or has in some other way been tampered with.

Applicant's invention will be described in more detail below with reference to the drawings in which.

Figure 1:
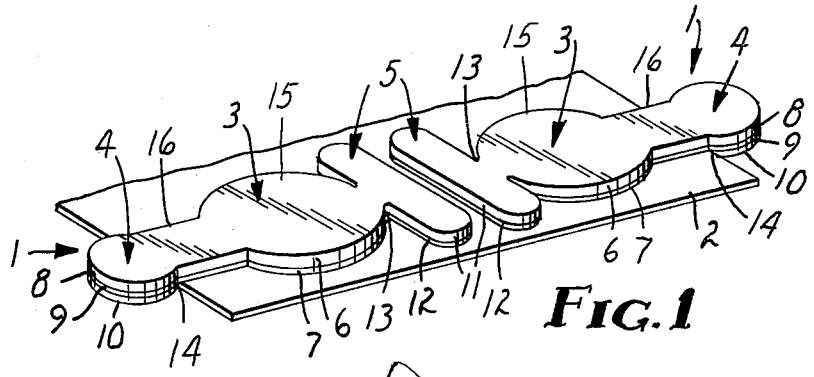
FIG. 1 is a perspective view of the device of the present invention in the form in which it would be supplied to the customer.

Now referring to the drawings in more detail, FIG. 1 shows the device of the present invention, hereinafter bottle cover 1, as duplicates on a release liner 2. The bottle cover 1, as shown, is in the form in which the customer would receive the bottle cover 1 on the release liner 2. The bottle cover 1 comprises closure portion 3, tab portion 4, and indicator portion 5. Closure portion 3 comprises backing 6 and adhesive 7 which will be described in more detail later. Tab portion 4 comprises backing 8, adhesive 9 and release liner 10. Indicator portion 5 comprises backing 11 and adhesive 12. Indicator portion 5 is connected to closure portion 3 through neck 13 which is narrower than indicator portion 5 is long to allow tab portion 4 and closure portion 3 to be removed from the bottle without the removal of indicator portion 5 as will be described in more detail below. Release liner 10 of tab portion 4 is cut along a line 14 so that release liner 10 remains with tab portion 4 when bottle cover 1 is removed from release liner 2. This provides a surface which is non-adhesive and can be handled by the user of bottle cover 1. Closure portion 4 comprises enlarged portion 15 and connecting portion 16 between enlarged portion 15 and tab portion 4.

Figure 2:
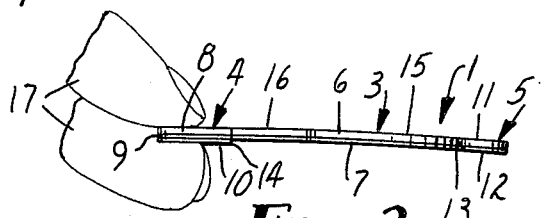
FIG. 2 is a side elevation view of the device of the present invention in the form in which it would be when ready for use.

FIG. 2, as noted, is a side elevation of the bottle cover 1 after removal from liner 2. The bottle cover 1 is held by fingers 17 and comprises tab portion 4 held between fingers 17 with closure portion 3 and indicator portion 5 extending therefrom. These portions are comprised as described with reference to FIG. 1.

It is important that at least backing 6 and 11 and preferably also backing 8 of closure portion 3, indicator portion 5 and tab portion 4 respectively of the bottle cover 1 of the present invention have the stiffness as described above in order that the tab can be handled with one hand and not bend in the hand so that it contacts the fingers of the user and be contaminated.

FIG. 2 provides a diagrammatic indication of this. This requirement can be quantified in terms of stiffness of the sheet of polymeric material comprising backing 6, 11 and preferably additionally backing 8 which must be at least 50 and more preferably, at least 70. Stiffness is defined as the length in millimeters a one-inch (2.54 cm) wide sample of sheet material can be extended horizontally past the edge of a horizontal support plate before the nonsupported edge of the sample sags ten millimeters in the vertical plane below the level of the support plate.

As noted, the sheet material comprising the backings 6, 11 of the closure portion 3 and indicator portion 5 of the bottle cover 1 must conform to the bottle top and neck. Conformability can be quantified and is determined according to the following formula:

$$\text{Conformability} = 1/F \times 100.$$

F is the force in pounds required to stretch a one-inch (2.54 cm) wide sample of the backing to 300 percent, i.e., 200 percent stretch of its original length at a loading rate of 12 inches (30 cm) per minute. The conformability of backings 6, 11 and preferably also backing 8 of the bottle cover 1 of the present invention should be at least 15 and preferably at least 25.

Figure 3:
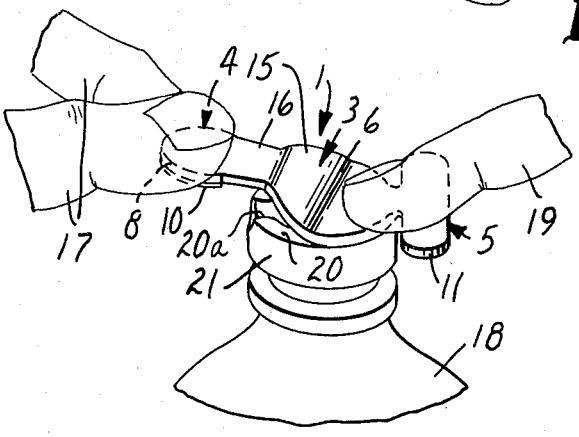
FIG. 3 is a perspective view of the device of the present invention shown as it is being applied to a bottle.

The relevance of conformability becomes more clear in respect to FIG. 3 which shows application of bottle cover 1 to bottle 18. As shown bottle cover 1 is held by fingers 17 gripping bottle cover 1 at tab portion 4. Finger 19 is utilized to press closure portion 3 against bottle top 20 containing groove 20*a* and cause the adhesive of enlarged portion 15 of closure portion 3 to become adhered to bottle top 20 and connecting portion 16 of closure portion 3 to become adhered to bottle top 20 and neck 21 around groove 20*a*. The conformability of the backing 6 of closure portion 3 allows the closure portion 3 to conform to the irregularities in the surface of bottle top 20 and neck 21 and form a seal which precludes the water-based liquids from passing out of bottle 18 through bottle top 20 and precludes microorganisms from contacting bottle top 20 and neck 21, where covered.

The sheet of polymeric material which comprises backing 6, 11 and preferably 8 must have both the stiffness and conformability characteristics described. It has been found that a material that has a conformability and stiffness most useful in the present invention yet is also impermeable by microorganisms and unaffected by water is closed-cell crosslinked polyethylene foam which has a density of four pounds per cubic foot (64 kilograms per cubic meter) and a thickness of 0.04 inch (1.10 cm). A preferred foam is "Volara" polyethylene foam supplied by Voltek Corporation, Lawrence, Mass. Other closed-cell polyethylene foams or other polyolefin foams which are closed-cell can also be used as well as other densities and thicknesses of said closed cell foams. Other materials such as other low density polymeric foams are also useful in the present invention. Foamed materials are preferred in the present invention because they provide the requisite combination of stiffness and conformability.

The pressure sensitive adhesive 7, 9 and 12 which is included in the closure portion 3, tab portion 4 and indicator portion 5, respectively, is at least in respect to adhesive 7, 12, relatively unaffected by water and nontoxic. Preferred adhesives are of the type described in U.S. Pat. No. Re. 24,906. A particularly preferred adhesive is one which comprises 94 percent by weight isooctyl acrylate units and 6 percent by weight acrylic acid units. Other adhesives which can be utilized are those described in U.S. Pat. No. 3,389,827 which comprise block copolymers having three or more polymer block structures having a general configuration —A—B—A— wherein each A is a thermoplastic polymer block with a glass transition temperature above room temperature (i.e., above about 20° C.) having an average molecular weight between about 5000 and 125,000 and B is a polymer block of a conjugated diene having an average molecular weight between about 15,000 and 250,000. Additional useful adhesives are crosslinked acrylate adhesives such as for example those described in U.S. Pat. No. 4,172,213.

As shown in FIG. 3, indicator portion 5 is not yet affixed to bottle neck 21. However, after closure portion 3 is in place on bottle top 20, indicator portion 5 is affixed to bottle neck 21 by means of finger 19 and is held in place by the adhesive of indicator portion 5. This is shown more clearly in FIG. 4.

Figure 4:
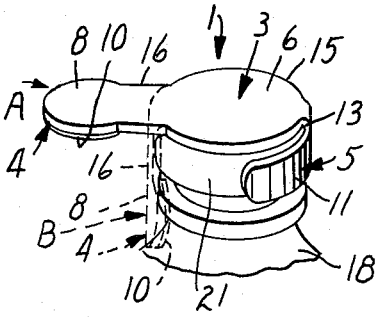
FIG. 4 is a perspective view of the device of the present invention as applied to the top of a bottle.

FIG. 4 depicts bottle cover 1 adhered to bottle 18, indicator portion 5 is attached to neck 21 of bottle 18 and closure portion 3 is attached to bottle top 20. Tab portion 4 is shown in two positions, A and B. Position A, the horizontal position, would be used if the bottle top 20 is uniform, i.e., does not contain groove 20*a*. If bottle top 20 and neck 21 contain groove 20*a*, as is the case with some I.V. bottles, the tab portion 3 would be in position B. In position B the adhesive on connector portion 16 of closure portion 3 adheres to the bottle top 20 and neck 21 around groove 20*a* to provide a watertight and microorganism-proof seal around groove 20*a*.

Figure 5:
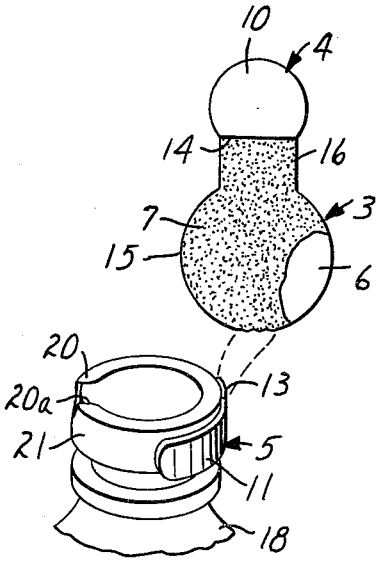
FIG. 5 is a perspective view of the device of the present invention showing the device as it is partially removed from the bottle top.

FIG. 5 depicts the bottle 18 after the tab portion 4 and closure portion 3 of the bottle cover 1 have been removed by pulling on tab 4 and ripping the bottle cover 1 at neck portion 13 leaving indicator portion 5 on neck 21. This indicates to the user that the reseal on the bottle has been removed and that the bottle has been tampered with or contains medicament and should not be used. The neck 13 is less wide than the indicator portion 5 is long in order that indicator 5 remain when tab portion 4 is pulled.

The release liner which is utilized in the present invention can be any type of normal silicone coated release paper or other types of release liners. The preferred release liner is bleached "Polyslik" liner supplied by H. P. Smith Company, Chicago, Ill. Other release liners known to the art can also be used.

As described above, normally the tab portion 4 will be rendered non-adhesive by the inclusion of release liner 10 that remains attached after the bottle cover 1 is removed from the main release liner 2. However tab portion 4 can be made in such a fashion or the adhesive 9 thereon treated by powder or otherwise to render it nonadhesive, thus removing the need for the release liner.

The bottle covers of the present invention can be produced in a two-step operation. In the first step the backing or polymeric sheet material, pressure-sensitive adhesive and liner are laminated on a conventional knife coater using conventional knife coater techniques. The pressure-sensitive adhesive solution is knife-coated onto the release liner, the pressure-sensitive adhesive solution is dried to remove solvents, and the backing is laminated to the dried pressure-sensitive adhesive coating with squeeze-roll pressure. This laminate is then used in a second step of the operation which is accomplished on a precision control depth die-cutting machine. The die-cutting machine is set up to make two continuous machine direction cuts through the liner layer only, i.e., the cuts for the tab liner. At subsequent stations on the die-cutting machine, other cuts are made from the opposite side of the web, cutting out the bottle cover outline. These cuts are made only through the backing and adhesive layers except at the tab ends where the die passes through the entire laminate. The waste trim is then pulled off and a continuous strip remains leaving the center of the liner with individual bottle covers attached. The tabs of the bottle covers with pieces of liner still intact extend past the liner edge for ease in grasping the bottle cover. As a final step, the strips of bottle covers are cut off into sheets of bottle covers ready for packing into the tray containers in which form they will be used.

The bottle cover of the present invention can be used to cover I.V. bottles or other bottles wherein it is important to maintain a microorganism-proof seal which also precludes the passage of water or aqueous solutions. The indicator portion of the bottle cover can be utilized not only to indicate the bottle has been resealed and that the reseal has been removed, but to provide a location for labeling the bottle and indicating the contents thereof.

What is claimed is:

1. A device for closing a bottle top comprising a closure portion and a tab portion, said tab portion being attached to said closure portion, said closure portion comprising a sheet of polymeric material which is conformable to a bottle top while being relatively stiff, impermeable to micoorganisms, relatively unaffected by water, incapable of passing liquid water therethrough, and having a conformability of at least 15 and a stiffness of at least 50, said closure portion containing an adhesive on one major surface thereof, said adhesive covering substantially at least the entire periphery of said major surface thereof and being relatively unaffected by water and non-toxic, said tab portion being relatively non-tacky on at least a portion thereof.

2. The device of claim 1 wherein the adhesive on said closure portion is covered with a release liner.

3. The device of claim 1 wherein there is attached to an edge of the closure portion of said device an indicator portion comprising a sheet of polymeric material which is conformable to a bottle neck while being relatively stiff, and having a conformability of at least 15 and a stiffness of at least 50 and which contains an adhesive on one major surface thereof, which major surface corresponds to the adhesive containing major portion of the closure portion, said adhesive being relatively unaffected by water and non-toxic, said indicator portion being attached to said closure portion by means in said indicator portion for providing a disattachment of said indicator portion from said closure portion by a relatively small amount of force.

4. The device of claim 3 wherein said indicator portion comprises a neck portion attached to said closure portion and an elongated portion attached to said neck portion, said elongated portion being greater in size than said neck portion.

5. The device of claim 3 wherein the adhesive on said closure portion is covered with a release liner.

6. A closed bottle comprising a bottle with a neck portion containing a bottle opening, said bottle being closed with the device of claim 3 with said closure portion affixed by the adhesive of said closure portion to the portions of said bottle surrounding said opening in said bottle and said indicator portion being adhesively attached to said neck of said bottle.

7. A method for closing a bottle having a neck portion containing a bottle opening, said method comprising applying the device of claim 3 to the bottle by placing the closure portion of the device over the parts of the bottle surrounding the opening in said bottle with the adhesive of said closure portion contacting said parts, pressing said closure portion on the parts of said bottle surrounding said opening to adhesively attach said closure portion to said parts and pressing said indicator portion to the neck of said bottle to adhesively attach said indicator portion to said neck.

8. A closed bottle comprising a bottle with a neck portion containing a bottle opening, said bottle being closed with the device of claim 1 with said closure portion affixed by the adhesive of said closure portion to the portions of said bottle surrounding said opening in said bottle.

9. A method for closing a bottle having a neck portion containing a bottle opening, comprising applying the device of claim 1 to the bottle by placing the closure portion of the device over the parts of the bottle surrounding the opening in said bottle with the adhesive of said closure portion contacting said parts, pressing said closure portion on the parts of said bottle surrounding said opening to adhesively attach said closure portion to said parts.

* * * * *

UNITED STATES PATENT AND TRADEMARK OFFICE

CERTIFICATE OF CORRECTION

PATENT NO. : 4,318,490

DATED : March 9, 1982

INVENTOR(S) : JOHN F. SCHNEIDER

It is certified that error appears in the above—identified patent and that said Letters Patent is hereby corrected as shown below:

Col. 3, l. 52, "(1.10 cm)" should read -- (0.10 cm) --.

Signed and Sealed this

*Twenty-first* Day of *September 1982*

[SEAL]

*Attest:*

GERALD J. MOSSINGHOFF

*Attesting Officer*

*Commissioner of Patents and Trademarks*